US005197758A

United States Patent [19]

Lund et al.

[11] Patent Number: 5,197,758

[45] Date of Patent: Mar. 30, 1993

[54] NON-AZIDE GAS GENERANT FORMULATION, METHOD, AND APPARATUS

[75] Inventors: Gary K. Lund, Ogden, Utah; Mikel R. Stevens, Fayetteville, Ark.; W. Wayne Edwards, Tremonton; Graham C. Shaw, III, Garland, both of Utah

[73] Assignee: Morton International, Inc., Chicago, Ill.

[21] Appl. No.: 774,755

[22] Filed: Oct. 9, 1991

[51] Int. Cl.[5] ..... G60Q 21/28

[52] U.S. Cl. ..... 280/741; 149/61

[58] Field of Search ..... 149/61; 280/741

[56] References Cited

U.S. PATENT DOCUMENTS

| | | | |
|---|---|---|---|
| 1,511,771 | 10/1924 | Rathsburg . | |
| 2,981,616 | 4/1961 | Boyer | 149/35 |
| 3,004,959 | 10/1961 | Finnegan et al. | 260/88.3 |
| 3,055,911 | 9/1962 | Finnegan et al. | 260/308 |
| 3,171,249 | 3/1965 | Bell | 60/35.4 |
| 3,348,985 | 10/1967 | Stadler et al. | 149/92 |
| 3,468,730 | 9/1969 | Gawlick et al. | 149/61 |
| 3,719,604 | 3/1973 | Prior et al. | 252/186 |
| 3,734,789 | 5/1973 | Moy et al. | 149/19 |
| 3,739,574 | 6/1973 | Godfrey | 60/39.3 |
| 3,741,585 | 6/1973 | Henrickson | 149/35 |
| 3,814,694 | 6/1974 | Klager | 252/186 |
| 3,873,477 | 3/1975 | Beck | 260/2.5 R |
| 3,898,112 | 8/1975 | Strecker et al. | 149/92 |
| 3,904,221 | 9/1975 | Shiki | 280/150 AB |
| 3,909,322 | 9/1975 | Chang et al. | 149/36 |
| 3,912,561 | 10/1975 | Doin et al. | 149/35 |
| 3,947,300 | 3/1976 | Passauer et al. | 149/35 |
| 3,954,528 | 5/1976 | Chang et al. | 149/92 |
| 4,203,787 | 5/1980 | Kirchoff et al. | 149/35 |
| 4,296,084 | 10/1981 | Adams et al. | 423/351 |
| 4,369,079 | 1/1983 | Shaw | 149/61 |
| 4,370,181 | 1/1983 | Lunstrom et al. | 149/109.2 |
| 4,376,002 | 3/1983 | Utracki | 149/35 |
| 4,547,235 | 10/1985 | Schneiter et al. | 149/35 |
| 4,865,667 | 9/1989 | Zeuner et al. | 149/22 |
| 4,931,112 | 6/1990 | Wardle et al. | 149/88 |
| 4,948,439 | 8/1990 | Poole et al. | 149/46 |
| 5,035,757 | 7/1991 | Poole et al. | 149/46 |

*Primary Examiner*—Stephen J. Lechert, Jr.
*Attorney, Agent, or Firm*—L. Dewayne Rutledge; Gerald K. White

[57] ABSTRACT

Gas generating compositions or propellants are provided which comprise a non-azide fuel which is a transition metal complex of an aminoarazole. Preferred transition metal complexes are zinc and copper complexes of 5-aminotetrazole and 3-amino-1,2,4-triazole, with the zinc complexes most preferred. The propellant compositions also include a conventional oxidizer, such as potassium nitrate or strontium nitrate. These compositions are useful for generating a nitrogen-containing gas for a variety of applications, especially for inflating air bags in automotive restraint systems, as well as other inflatable devices.

20 Claims, No Drawings

NON-AZIDE GAS GENERANT FORMULATION, METHOD, AND APPARATUS

BACKGROUND OF THE INVENTION

1. Field of the Invention

This invention relates to non-azide gas generant, or propellant compositions, generally in pellet or tablet form, which are burned to provide primarily nitrogen gas to inflate automobile air bag restraint systems. More particularly this invention relates to improved propellant compositions including an oxidizer and a novel non-azide fuel for producing the gas comprising a transition metal complex of an aminoarazole.

Though the gas generant or propellant compositions of this invention are especially designed and suited for creating a nitrogen-containing gas for inflating passive restraint vehicle crash bags, they would function equally well in other less severe inflation applications, such as aircraft slides and inflatable boats; and, more generally, would find utility for any use where a low temperature, non-toxic gas is needed, such as for a variety of pressurization and purging applications, as in fuel and oxidizer tanks in rocket motors; for various portable and military equipment and operations where a storable source of gas is needed.

2. Description of the Prior Art

Automobile air bag systems have been developed to protect the occupant of a vehicle, in the event of a collision, by rapidly inflating a cushion or bag between the vehicle occupant and the interior of the vehicle. The inflated air bag absorbs the occupants' energy to provide a gradual, controlled ride down, and provides a cushion to distribute body loads and keep the occupant from impacting the hard surfaces of the vehicle interior.

The most common air bag systems presently in use include an on-board collision sensor, an inflator, and a collapsed, inflatable bag connected to the gas outlet of the inflator. The inflator typically has a metal housing which contains an electrically initiated igniter, a gas generant composition, for example, in pellet or tablet form, and a gas filtering system. Before it is deployed, the collapsed bag is stored behind a protective cover in the steering wheel (for a driver protection system) or in the instrument panel (for a passenger system) of the vehicle. When the sensor determines that the vehicle is involved in a collision, it sends an electrical signal to the igniter, which ignites the gas generant composition. The gas generant composition burns, generating a large volume of relatively cool gaseous combustion products in a very short time. The combustion products are contained and directed through the filtering system and into the bag by the inflator housing. The filtering system retains all solid and liquid combustion products within the inflator and cools the generated gas to a temperature tolerable to the vehicle passenger. The bag breaks out of its protective cover and inflates when filled with the filtered combustion products emerging from the gas outlet of the inflator. See, for example, U.S. Pat. No. 4,296,084.

The requirements of a gas generant suitable for use in an automobile air bag are very demanding. The gas generant must burn very fast to inflate the air bag, for example, in about 30 milliseconds or less, but the burn rate must be stable, controllable and reproducible to ensure bag deployment and inflation in a manner which does not cause injury to the vehicle occupants or damages to the bag.

The gas generant must be extremely reliable during the life of the vehicle (ten years or more). Ignition must be certain, and the burn rate of the gas generant composition must remain constant despite extensive exposure of the composition to vibration and a wide range of temperatures. The gas generant is protected from moisture when sealed in the inflator, but should still be relatively insensitive to moisture to minimize problems during manufacture and storage of the gas generant and assembly of the inflator, and to ensure reliability during the life of the air bag system.

The gas generant must efficiently produce cool, non-toxic, non-corrosive gas which is easily filtered to remove solid or liquid particles, and thus to preclude injury to the vehicle occupants and damage to the bag.

It follows then that the most desirable atmosphere inside an inflated crash bag would correspond in composition to the air outside it. This has thus far proven impractical to attain. The next best solution is inflation with a physiologically inert or at least innocuous gas. The one gas which possesses the required characteristics and which has proven to be the most practical is nitrogen.

The most sucessful to date of the prior art solid gas generants which produce nitrogen that are capable of sustained combustion have been based upon the decomposition of compounds of alkali metal, alkaline earth metal and aluminum derivatives of hydrazoic acid, especially sodium azide. Such azide-containing gas generants are disclosed in, for example, U.S. Pat. Nos. 2,981,616; 3,814,694; 4,203,787 and 4,547,235.

There are some disadvantages, however, to the use of azides in gas generant compositions used for inflating air bag systems. For instance, sodium azide is a Class B poison and is a highly toxic material. It is easily hydrolyzed, forming hydrazoic acid which is not only a highly toxic and explosive gas, but also readily reacts with heavy metals such as copper, lead, etc. to form extremely sensitive solids that are subject to unexpected ignition or detonation. Especially careful handling in the manufacture, storage and eventual disposal of such materials is required to safely handle them and the azide-containing gas generants prepared from them.

A number of approaches to a non-azide nitrogen gas generant have been investigated in the prior art, as disclosed, for example in U.S. Pat. Nos. 3,004,959; 3,055,911; 3,348,985; 3,719,604 and 3,909,322. Many of the prior art nitrogen gas generants that have been reported are based upon nitrogen-containing compounds such as those derived from the various hydroxylamine acid and hydroxylamine derivatives, while others consist of various polymeric binders, hydrocarbons and carbohydrates which are oxidized to produce non-corrosive and, often termed, "non-toxic" gases. The gas products from these compositions, however, contain unacceptably high levels of carbon dioxide, carbon monoxide and water for use in automobile air bag applications where the possibility exists that the occupant may breathe, even for short periods of time, high concentrations of the gases produced from the gas generant. Thus, these compositions do not meet the present requirements that the combustion products meet industrial standards for toxic and other gases such as carbon monoxide, carbon dioxide, etc.

Non-azide materials, such as tetrazole derivatives have also been used in gas generant and explosive compositions. For example, U.S. Pat. No. 1,511,771 discloses that alkali, alkaline earth and heavy metal salts of tetrazole, tetrazoleazoimid, diazotetrazoleimid, azotetrazole, oxyazotetrazole, diazoaminotetrazole, diazotetrazole, bistetrazole, phenyltetrazole carbon acid, methyl mercaptotetrazole, substituted dioxytetrazoles, phenethenyldioxytetrazol, β-naphthenyldioxytetrazol, phenylglcyolendroxytetrazole, benzenyldioxytetrazol, meta-nitro-benzenyldioxytetrazol, and para-tolenyldioxytetrazole are useful in explosive compositions.

U.S. Pat. No. 3,055,911 discloses vinyltetrazoles which can be polymerized to provide polymers having large percentages of nitrogen. These polymers are useful as polymeric fuel matrices and binders for composite propellants and explosives.

U.S. Pat. No. 3,171,249 discloses hydrazine-based rocket fuels which contain aminotetrazole or its salts. The addition of aminotetrazole to the rocket fuel is said to make the fuel storable and have a lower freezing point.

U.S. Pat. No. 3,348,985 discloses gas generating compositions containing a mixture of ammonium nitrate and aminotetrazole. The gas generants are said to increase the useable and effective gas volume produced by the generant.

U.S. Pat. No. 3,468,730 discloses propellants containing a tetrazole derivative such as 5-aminotetrazole, guanylamino-5-tetrazole or 1-guanyl-3-tetrazolyl-guanidine. The propellant also contains an oxidizer such as barium nitrate, potassium dichromate, potassium nitrate, lead dioxide, copper oxide and manganese dioxide.

U.S. Pat. No. 3,719,604 relates to gas generating compositions containing aminoguanidine salts of azotetrazole or of ditetrazole. These compositions are said to generate large quantities of gas, but without explosive spontaneous decomposition.

U.S. Pat. No. 3,734,789 discloses gas generating solid composite propellants containing 5-aminotetrazole nitrate as the oxidant component. Likewise, U.S. Pat. No. 3,739,574 discloses a gas generator which may contain 5-aminotetrazole.

U.S. Pat. No. 3,873,477 discloses 5-aryltetrazole metal salts of zinc, barium, calcium, lead and aluminum which are useful as blowing agents in high-temperature processing of such polymers as polycarbonates and polysulfone resins.

U.S. Pat. No. 3,898,112 discloses a solid, gas generating propellant based on 5-aminotetrazole nitrate as the oxidant. Solid gas generating compositions are also disclosed in U.S. Pat. No. 3,909,322 which contains nitroaminotetrazole salts such as guanidinium 5-nitroaminotetrazole, ammonium 5-nitroaminotetrazole and hydrazinium 5-nitroaminotetrazole. The composition also contains an oxidant which can, for example, be 5-aminotetrazole nitrate.

U.S. Pat. No. 3,912,561 relates to a gas generating composition comprising an azide fuel, an oxidant, and a nitrogenous compound selected from aminotetrazole, aminotetrazole hydrate, azodicarbonamide and azotetrazole. The composition is said to produce a high yield of substantially non-toxic gas at moderate temperature and within a short period of time.

U.S. Pat. No. 3,954,528 discloses gas generants containing triaminoguanidine nitrate and an oxidant. One example of the oxidant is 5-aminotetrazole nitrate.

U.S. Pat. No. 4,369,079 discloses solid, non-azide nitrogen gas generant compositions which contain a metal salt of a non-hydrogen containing tetrazole compound selected from alkali metal salts and alkaline earth metal salts of, e.g., bitetrazole or azotetrazole compounds such as aminotetrazole, bistetrazoletetrazine, tetrazole, polyhydrazides or poly azo-alkyl.

Finally, U.S. Pat. No. 4,370,181 relates to solid, non-azide gas generating compositions which contain a non-hydrogen containing metal salt of 5,5'-bitetrazole, including the disodium, dipotassium and calcium salts of bitetrazole.

In contrast to the above discussed prior art, it has now been discovered that improved non-azide, gas generating compositions can be made using transition metal complexes of aminoarazoles.

SUMMARY OF THE INVENTION

In accordance with the present invention, improved solid nitrogen gas generating compositions are provided comprising a non-azide fuel (i.e., source of gas) and an oxidizer wherein the improvement comprises using as the non-azide fuel a transition metal complex of an aminoarazole.

In accordance with the present invention, the preferred aminoarazole transition metal complexes are zinc and copper complexes of 5-aminotetrazole (AT) and 3-amino-1,2,4-triazole (ATr). The $Zn(AT)_2$ complex is most preferred.

The propellant compositions according to the invention contain a conventional oxidizer, such as $KNO_3$, $Sr(NO_3)_2$ or mixtures thereof, preferably $Sr(NO_3)_2$. Also such compositions optionally contain from about 0.1 to 5 wt. % of a binder, preferably $MoS_2$.

In accordance with the present invention, there is also provided a method for generating primarily nitrogen gas comprising igniting a gas generant composition comprising a transition metal complex of an aminoarazole.

Further provided in accordance with this invention is a method of inflating an air bag comprising: igniting an improved gas generating material of a transitional metal complex of an aminoarazole and an oxidizer, as above described, to generate a gas; and using the gas produced therefrom to inflate the air bag.

Also, in accordance with this invention, an automotive air bag inflator system is provided comprising:

a metal housing having a gas outlet;

an improved gas generating composition including a transition metal complex of an aminoarazole and an oxidizer, as above described, disposed within said housing; an igniter disposed within said housing adjacent to said composition; and a gas filtering system disposed between said composition and the outlet.

Other objects and advantages of the present invention will become apparent to those skilled in the art from the following detailed description and appended claims.

DETAILED DESCRIPTION OF PREFERRED EMBODIMENTS

The principal aspect of this invention relates to gas generant or propellant compositions based on transition metal complexes of an aminoarazole as the non-azide gas producing fuel material. As used herein, the term "aminoarazole" refers to compounds which contain either a tetrazole or triazole ring with at least one amino group bonded directly to at least one of the carbon atoms of the tetrazole or triazole ring. And 5-aminotetrazole (AT) —Structure I— and 3-amino-1,2,4-triazole (ATr) —Structure II— are examples of such aminoarazoles and have the following formulas:

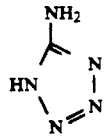

STRUCTURE I

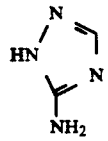

STRUCTURE II

Examples of the transition metal complexes of At and ATr include, but are not limited to, $Zn(AT)_2$ $Cu(AT)_2 \cdot \frac{1}{2} H_2O$, Cu(ATr) and Zn(X) (ATr) where X is $Cl^-$, $CH_3CO_2^-$ and the like. The preferred transition metal complex is $Zn(AT)_2$ because it is readily made, is easy to handle and is relatively insensitive to decomposition and ignition.

The transition metal complexes of this invention possess several advantages in gas generants over previously employed nitrogen producing materials. First, they avoid the aforementioned disadvantages of the azide compounds. Second, while various aminotetrazoles per se are known to be adequate generators of nitrogen gas (see several of the U.S. patents aforementioned), they produce an undesirable quantity of water as a by-product and are typically hygroscopic. The transition metal complexes of this invention, on the other hand, are much less hygroscopic than simple alkali or alkaline earth salts of aminoarazoles. In addition, gas generating compositions made from these transition metal complexes are thermally stable, have acceptable burn rates and, upon ignition with conventional oxidizers, produce high nitrogen gas yields and yield products, including refractory residues which meet all of the requirements of air bag inflators.

The novel transition metal aminoarazole complex fuels are intended as complete replacements for typical non-azide (or azide) fuel components used in propellant compositions, as disclosed. However, if desired, the fuel according to the invention may be partially substituted for such conventional fuel in any range from 1-99%, preferably greater than 50%, by weight, especially when destined for less severe use than vehicle crash bags.

The transition metal complexes useful in the present invention are readily prepared. In general, the complexes are made by admixing a salt of the transition metal, such as the chloride, acetate, perchlorate, nitrate or tetrafluoroborate salt of the transition metal, with the sodium salt of the aminoarazole or the aminorazole in water and recovering the neutral complex as a precipitate. See Examples 1-4.

The gas generating or propellant compositions of the present invention contain, in addition to the transition metal complexed aminoarazole fuel component, other conventional components commonly used in gas generating compositions which are ignited and used to inflate automobile air bags. For example, an oxidizer for the aminoarazole nitrogen-producing fuel is normally used, which is preferably anhydrous. Such oxidizers include metallic nitrites and nitrates, such as $KNO_3$ and $Sr(NO_3)_2$, and various oxides sulfides, iodides, perchlorates, chromates, peroxides, permanganates and mixtures thereof, such as those disclosed in U.S. Pat. Nos. 3,741,585 and 3,947,300. The preferred oxidizers are not only anhydrous, as aforementioned, but ones which provide low flame temperatures and which do not produce water as a by-product in the combustion reaction(s). The preferred anhydrous oxidizer is $KNO_3$, $Sr(NO_3)_2$ or mixtures thereof, with $Sr(NO_3)_2$ being most preferred.

According to the invention, a typical fuel and oxidizer reaction is represented by the following equation:

$$5[Zn(CH_3N_5)_2]+7[Sr(NO_3)_2 \rightarrow 32(N_2)+10(CO_2)+3(H_2O)+5(ZnO)+7[Sr(OH_2)]$$

Mixtures of the aminoarazole fuel and such oxidizers can be pressed into cohesive pellets or tablets which are sometimes sufficiently rugged for use in an air bag generator without a binder component being present. However, it is usually necessary to provide a small proportion of a binder therewith, usually from about 0.1 to 5 wt. %, preferably about 1-2 wt. %. Examples of specific binders contemplated herein are $MoS_2$, polyethylene glycol, polypropylene carbonate, polyethylene-copolyvinylacetate, acrylic latex suspensions and other suitable thermoplastic polymeric materials. See, for example, aforementioned U.S. Pat. Nos. 4,203,787; 4,370,181; 4,547,235 and 4,865,667. Other ingredients may be used in the propellant composition, such as $Al_2O_3$ and $SiO_2$ and for the well known residue control purposes taught in aforementioned U.S. Pat. Nos. 3,912,561; 3,947,300; 4,547,235 and 4,865,667. Additional ingredients in the composition should be minimized, particularly inert ingredients which do not contribute to the volume of gas generated or which may introduce deleterious combustion products therein. One exception is burn rate enhancers or boosters such as heat conducting fibers, e.g. graphite or iron fibers, added in small amounts of usually less than 6, preferably less than 2, wt. % which increase the burn rate of the propellant by transferring heat during combustion, as is well known in the art.

Broad and preferred ranges of relative amounts of gas generant and oxidizer according to the invention are set out below.

The fuel component (transition metal complexed aminoarazole) of the gas generant composition invention can range from about 20 to 60% by wt. based on the total wt. of the composition, preferably from about 30 to 45 wt. %.

The oxidizer component of the propellant composition invention can range from about 40 to 80% by wt. based on the total wt. of the composition, preferably from about 55 to 70 wt. %.

The gas generants of the present invention may be prepared by conventional techniques. For example, the ingredients of the gas generants, which include the transition metal complex of an aminoarazole and an oxidizing agent such as $Sr(NO_3)_2$ and/or $KNO_3$, may simply be blended together to form a homogeneous mixture, along with other optional ingredients, such as a binder, as above discussed. In normal commercial use, the gas generating composition is then pelletized or made into tablet form.

Another aspect of the invention involves a method of generating nitrogen gas for general use by igniting the composition of the invention previously described.

Another aspect of the invention involves using the nitrogen gas thus produced from the invention composition to inflate air bags in a wide variety of well known gas generator mechanisms, particularly in an automotive air bag system comprising a metal housing having a gas outlet; a particulate gas generating composition as described disposed within the housing; an igniter disposed within the housing adjacent to the gas generating composition; and a gas filtering system disposed between the composition and the gas outlet of the metal housing. More specific details and illustration of an exemplary type of inflator system contemplated herein are found in aforementioned U.S. Pat. Nos. 4,296,084 (which is incorporated herein in its entirety by reference) and 4,931,112.

The following examples serve to further illustrate the present invention, and are not intended to limit it in any manner. All percentages used in the following examples, and throughout this specification, are percent by weight unless specified otherwise.

EXAMPLE 1

This example illustrates the preparation of a transition metal complex of an aminoarazole, i.e., a cuprous 3-amino-1,2,4-triazole complex, Cu(ATr).

2.0 g of hydroxylamine hydrochloride ($NH_2OH.HCl$) and 10 ml of $NH_4OH$ were added to 50 ml of water. 2.76 g of triazole was added to 50 ml of anhydrous ethanol, 2.5 g of $CuSO_4.5H_2O$ (0.01 mole) was added to 100 ml of water and the resulting mixture heated to boiling. Once the $CuSO_4.5H_2O$ mixture was boiling, the $NH_2OH.HCl/NH_4OH$ solution was quickly added thereto. The reaction mixture quickly changed color from blue to orange to clear. The triazole solution was immediately added to the clear reaction mixture and the reaction mixture turned to a milky white solution.

The resulting product was filtered and a solid recovered which was dried in a vacuum oven. The product was analyzed and found to contain: N=31.9%, C=18.5%, H=1.57%, Cu=42.4%.

EXAMPLE 2

This example illustrates the preparation of a transition metal of an aminoarazole, i.e., a zinc complex of 5-aminotetrazole, $Zn(AT)_2$.

17.0 g of 5-aminotetrazole (AT) in hot water was added to 200–300 ml of water. The AT was allowed to dissolve in the water, whereupon 2.2 g of $(CH_3CO_2)Zn.2H_2O$ was added to the solution. A white precipitate formed immediately.

The precipitate was recovered and analyzed. It contained: C=10.04%, H=1.66%, N=58.27%, Zn=20.82%.

EXAMPLE 3

This example illustrates the preparation of a transition metal complex of an aminoarazole, i.e., a copper (II) complex of 5-aminotetrazole, $Cu(AT)_2$.

0.67 g of $CuSO_4.5H_2O$ was dissolved in 500 ml of water. To this solution was added 11.83 g 5-aminotetrazole (AT). The resulting reaction mixture was refluxed for several days. The solution was apple green at first, and within about one hour the solution turned from apple green to olive green. After about two hours the solution was purple.

The precipitate was recovered and analyzed. It contained C=9.98%, H=1.90%, N=56.2%, Cu=30%.

EXAMPLE 4

This example illustrates the preparation of the bis-nitrite complex of zinc with 3-amino-1,2,4-triazole.

To a solution of 18 grams of $Zn(NO_3)_2(6H_2O)$ and 41.4 grams of $NaNO_2$ in water (200 ml) was added a solution of 5.04 grams 3-amino-1,2,4-triazole and 4.32 grams $NaHCO_3$ in 300 ml water. The addition was done in a dropwise manner over approximately 30 minutes. A pale yellow to off-white precipitate immediately resulted and this was further digested for one hour at 70° to 77° C.

The precipitate was filtered, washed with distilled water and dried. Analysis of the precipitate showed it to contain: C=12.6 percent, H=1.38 percent, N=36.2 percent, and Zn=33.1 percent, corresponding to empirical formula: $Zn(C_2H_3N_4)(NO_2)$.

EXAMPLE 5

A gas generating composition was prepared in a conventional manner using the following ingredients:

| | Zn(AT) | $Sr(NO_3)_2$ |
|---|---|---|
| Composition A | 44.0% | 56.0% |
| Composition B | 29.0% | 71.0% |

These compositions had the following burning rates and theoretical performance:

| Burning Rate (in/sec at 1000 psi) | |
|---|---|
| A: | 0.539 ± 0.02 |
| B: | 0.446 ± 0.05 |

| | Theoretical Performance | | | | | | |
|---|---|---|---|---|---|---|---|
| | % Gas Relative to Azide Composition | % $N_2$ | % $CO_2$ | % $H_2O$ | % CO | % $O_2$ | Flame Temp (°K.) |
| A: | 121 | 59.1 | 29.0 | 11.8 | 10 ppm | 0.1 | 2411 |
| B: | 119 | 50.9 | 21.1 | 5.5 | 0 | 22.5 | 1450 |

The above data indicates improved gas yields relative to sodium azide formulations and acceptable burning rates are obtained. Moisture content, flame temperature and burning rate are all controlled by the fuel to oxidizer ratio.

EXAMPLE 6

A gas generating composition was prepared in a conventional manner using the following ingredients and burning rates determined at 1000 psi:

| | $Cu(AT)_2.\frac{1}{2}H_2O$ | $Sr(NO_3)_2$ | Burning Rate (in/sec at 1000 psi) |
|---|---|---|---|
| C: | 36%* | 62% | 0.607 |
| D: | 40%* | 58% | 0.790 |
| E: | 24.5%** | 73.5% | 0.363 |

*Green form
**Purple form

The following theoretical performance parameters are predicted for the formulations labeled "C" and "D" respectively:

| | % Gas Relative to Azide Composition | Theoretical Performance % $N_2$ | % $CO_2$ | % $H_2O$ | % $O_2$ | Flame Temp (°K.) |
|---|---|---|---|---|---|---|
| C: | 120 | 50.5 | 21.8 | 7.8 | 19.9 | 1513 |
| D: | 127 | 56.7 | 28.4 | 14.6 | 0.3 | 2390 |

The above data indicates similar gas yields, flame temperature and burning rates are obtained with the Cu complexes and the Zn complexes described in Example 5.

EXAMPLE 7

Gas generating compositions were prepared in a conventional manner with the aminotriazole complex fuel described in Example 4 using the following ingredients. Burning rates were determined at 1000 psi.

| | $Zn(ATr)(NO_2)$ | $Sr(NO_3)_2$ | $KNO_3$ | Burning Rate (in/sec at 1000 psi) |
|---|---|---|---|---|
| A: | 50.0% | 50.0% | — | 0.432 |
| B: | 51.6% | — | 48.4% | 0.651 |

The following theoretical performance parameters are predicted for each of the above formulations:

| | % Gas Relative to Azide Composition | Theoretical Performance % $N_2$ | % $CO_2$ | % $H_2O$ | % $O_2$ | Flame Temp (°K.) |
|---|---|---|---|---|---|---|
| A: | 133.4 | 41.9 | 38.6 | 11.8 | 7.7 | 1582 |
| B: | 112.6 | 51.0 | 25.9 | 14.5 | 8.6 | 1654 |

These data indicate similar flame temperatures and burning rates are obtained with aminotriazole complexes relative to those prepared with aminotetrazole as described in Example 5. Furthermore, burning rate is increased by the use of potassium nitrate rather than strontium nitrate as oxidizer although gas yields are somewhat reduced.

While the invention has been described in terms of certain preferred embodiments, modifications obvious to one having ordinary skill in the art may be made without departing from the scope of the present invention.

Various features of the invention are set forth in the following claims.

We claim:

1. A solid composition for generating a nitrogen-containing gas including a non-azide fuel and an oxidizer therefor, wherein said non-azide fuel comprises a transition metal complex of an aminoarazole.

2. A composition according to claim 1 wherein said aminoarazole is selected from the group consisting of a transition metal complex of 5-aminotetrazole and a transition metal complex of 3-amino-1,2,4-triazole.

3. A composition according to claim 2 wherein said transition metal is selected from the group consisting of zinc and copper.

4. A composition according to claim 3 wherein said transitional metal complex is a zinc complex of 5-aminotetrazole.

5. A composition according to claim 3 wherein said transitional metal complex is a zinc complex of 3-amino-1,2,4-triazole.

6. A composition according to claim 1 wherein the oxidizer is selected from the group consisting of $KNO_3$, $Sr(NO_3)_2$ and mixtures thereof.

7. A composition according to claim 4 wherein the oxidizer is $Sr(NO_3)_2$.

8. A composition according to claim 5 wherein the oxidizer is $Sr(NO_3)_2$.

9. A method of generating a nitrogen-containing gas comprising igniting a solid composition including a non-azide fuel and an oxidizer therefor, wherein the fuel comprises a transition metal complex of an aminoarazole.

10. A method according to claim 9 wherein the aminoarazole is selected from the group consisting of a transition metal complex of 5-aminotetrazole and a transition metal complex of 3-amino-1,2,4-triazole.

11. A method according to claim 10 wherein said transition metal complex is a zinc complex of 5-aminotetrazole.

12. A method according to claim 10 wherein said transition metal complex is a zinc complex of 3-amino-1,2,4-triazole.

13. A method according to claim 11 wherein the oxidizer is $Sr(NO_3)_2$.

14. A method according to claim 12 wherein the oxidizer is $Sr(NO_3)_2$.

15. A method according to claim 9 further comprising using the gas produced to inflate an air bag.

16. A method according to claim 15 wherein the aminoarazole is selected from the group consisting of a transition metal complex of 5-aminotetrazole and a transition metal of 3-amino-1,2,4-triazole.

17. A method according to claim 16 wherein said transition metal complex is a zinc complex of 5-aminotetrazole.

18. A method according to claim 16 wherein said transition metal complex is a zinc complex of 3-amino-1,2,4-trizaole.

19. A method according to claim 16 wherein the oxidizer is selected from the group consisting of $KNO_3$, $Sr(NO_3)_2$ and mixtures thereof.

20. An automotive air bag inflator comprising a metal housing having a gas outlet, a solid gas generating composition including a non-azide fuel and an oxidizer therefor disposed within said housing, an igniter disposed within said housing adjacent to said composition, and a gas filtering system disposed between said composition and said outlet, wherein said fuel comprises a transition metal complex of an aminoarazole.

* * * * *